US007146324B2

(12) United States Patent
Den Brinker et al.

(10) Patent No.: US 7,146,324 B2
(45) Date of Patent: Dec. 5, 2006

(54) AUDIO CODING BASED ON FREQUENCY VARIATIONS OF SINUSOIDAL COMPONENTS

(75) Inventors: Albertus Cornelis Den Brinker, Eindhoven (NL); Andreas Johannes Gerrits, Eindhoven (NL); Erik Gosuinus Petrus Schuijers, Eindhoven (NL); Gerard Herman Hotho, Eindhoven (NL); Christophe Alain Bernard Hoeppe, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 832 days.

(21) Appl. No.: 10/278,386

(22) Filed: Oct. 23, 2002

(65) Prior Publication Data

US 2003/0083886 A1 May 1, 2003

(30) Foreign Application Priority Data

Oct. 26, 2001 (EP) ..... 01204062
Jan. 25, 2002 (EP) ..... 02075316

(51) Int. Cl.
*G10L 19/00* (2006.01)

(52) U.S. Cl. ..... 704/500

(58) Field of Classification Search ..... None
See application file for complete search history.

(56) References Cited

U.S. PATENT DOCUMENTS 6,925,434 B1 * 8/2005 Oomen et al. ..... 704/206

FOREIGN PATENT DOCUMENTS

CN 1318188 A 10/2001

OTHER PUBLICATIONS

International Publication No. WO00/79519, Publication Date Dec. 28, 2000, International Application No. PCT/EP00/05344, Audio Transmission System Having an Improved Encoder, by Taori et al.

International Publication No. WO01/69593, Publication Date Sep. 20, 2001, International Application No. PCT/EP01/02424, "Laguerre Function for Audio Coding", by Oomen et al.

International Publication No. WO01/89086, Publication Date Nov. 22, 2001, International Application No. PCT/EP00/04599, "Spectrum Modeling" by Den Brinker et al.

U.S. Appl. No. 10/123,791, filed Apr. 16, 2001, "Audio Coding", by Den Brinker et al.

"A Time Warper for Speech Signals", by R.J. Sluijter, IEEE Workshop on Speech Coding, Porvoo, Finland, Jun. 20-23, 1999 pp. 150-152.

* cited by examiner

*Primary Examiner*—Susan McFadden

(57) ABSTRACT

Coding of an audio signal is provided where an indicator of the frequency variation of sinusoidal components of the signal is used in the tracking algorithm of a sinusoidal coder where sinusoidal parameters from appropriate sinusoids from consecutive segments are linked. By applying an indicator such as a warp factor or polynomial fitting, more accurate tracks are obtained. As a result, the sinusoids can be encoded more efficiently. Furthermore, a better audio quality can be obtained by improved phase continuation.

29 Claims, 9 Drawing Sheets

AUDIO CODING BASED ON FREQUENCY VARIATIONS OF SINUSOIDAL COMPONENTS

FIELD OF THE INVENTION

The present invention relates to coding and decoding audio signals.

BACKGROUND OF THE INVENTION

A parametric coding scheme in particular a sinusoidal coder is described in PCT patent application No. WO 00/79519-A1 (Attorney Ref. N 017502) and European Patent Application No. 01201404.9, filed Apr. 18, 2001 (Attorney Ref. PHNL010252). In this coder, an audio segment or frame is modelled by a sinusoidal coder using a number of sinusoids represented by amplitude, frequency and phase parameters. Once the sinusoids for a segment are estimated, a tracking algorithm is initiated. This algorithm tries to link sinusoids with each other on a segment-to-segment basis. Sinusoidal parameters from appropriate sinusoids from consecutive segments are thus linked to obtain so-called tracks. The linking criterion is based on the frequencies of two subsequent segments, but also amplitude and/or phase information can be used. This information is combined in a cost function that determines the sinusoids to be linked. The tracking algorithm thus results in sinusoidal tracks that start at a specific time instance, evolve for a certain amount of time over a plurality of time segments and then stop.

The construction of these tracks allows for efficient coding. For example, for a sinusoidal track, only the initial phase has to be transmitted. The phases of the other sinusoids in the track are retrieved from this initial phase and the frequencies of the other sinusoids. The amplitude and frequency of a sinusoid can also be encoded differentially with respect to the previous sinusoids. Furthermore, tracks that are very short can be removed. As such, due to the tracking, the bit rate of a sinusoidal coder can be lowered considerably.

Tracking is therefore important for coding efficiency. However, it is important that correct tracks are made. If sinusoids are incorrectly linked, this can increase the bit rate unnecessarily or degrade the reconstruction quality.

It is known, however, that sinusoid frequencies within segments of lengths in the order of 10–20 ms can be non-stationary, making the sinusoidal model less adequate. Take, for example, a harmonic signal which is continually increasing in pitch. If a single sinusoid is used to estimate say the average frequency of the fundamental frequency within a segment, then when this sinusoid is subtracted from the sampled signal, it will leave a residual harmonic frequency which the sinusoidal coder will attempt to fit with a high frequency harmonic. These "ghost" harmonics may then be matched in the tracking algorithm and included in the final encoded signal which when decoded will include some distortion as well as requiring a higher bit rate than necessary to encode the signal.

In PCT Application No. WO00/74039 and R. J. Sluijter, A. J. E. Janssen, "A time warper for speech signals" IEEE Workshop on Speech Coding, Porvoo, Finland, Jun. 20–23, 1999, pp. 150–152 there is disclosed a time warper to enhance the stationarity of an audio segment.

Sluijter et al disclose a method to obtain a warp parameter a for a segment. By warping the segment with a warp function of the form:

$$\tau(t) = \frac{a}{T}t^2 + (1-a)t,\ 0 \le t \le T \qquad \text{Equation 1}$$

in which T represents the duration of the segment in seconds, t represents real time and T stands for the warped time, the time warper removes the part of the frequency variation which progresses linearly with time, without changing the time duration of that segment.

By applying the time warper proposed by Sluijter et al, the problem of non-stationarity of frequencies can be alleviated, and so a sinusoidal coder can more reliably estimate the frequencies within a warped segment. Sluijter et al also discloses the transmission of the warp factor in a bit-stream so that the warp factor may be used in synthesizing warped sinusoids within a decoder.

As an example of the improvements provided by Sluijter et al, a harmonic signal is used where the fundamental frequency is changing rapidly. FIG. 4 shows the result of tracking when no warping is used at all. The lines indicate the continuation of a track, the circles represent the start or end of a track and the stars indicate single points. As can be seen from the figure, the higher frequencies (2000–6000 Hz) are for a large part missing or incorrect. As a result, incorrect tracks are made. The analysis interval has a length of 32.7 ms, with an update interval of 8 ms. (Usually a segment overlap is employed during synthesis of the encoded signal, and so where an overlap of 50% is used, there is an segment length of 16 ms.) Since the frequencies are not stationary in such a long analysis interval, the sinusoidal coder cannot estimate the higher frequencies well.

By doing the estimation on segments time-warped according to Sluijter, all frequencies are estimated correctly, as can be seen in FIG. 5. However, the figure also shows that at some instances, incorrect tracks are made.

This is because once a group of frequencies has been estimated for one segment, the tracking algorithm attempts to link these with the group of frequencies of the next segment without taking into account the frequency variation of sinusoidal components within sequential segments. So as shown in FIG. 6(*a*), a frequency $f_k$ is estimated for a segment k where a warping factor $a_1$ has been determined. (In FIGS. 6(*a*) and 6(*b*) the warping factors $a_1$,$a_2$ are shown as the angle of the slope of the frequency, however, in practice the frequency derivative (slope) equals a/T.) At the same time frequencies $f_{k+1}(1)$ and $f_{k+1}(2)$ are estimated for a segment k+1 where a warping factor $a_2$ has been determined. If the frequency variation is not taken into account in linking sinusoids from one segment to the next, then in the example, it is more likely that $f_k$ will be linked to $f_{k+1}(1)$ rather than $f_{k+1}$ (2) as the difference in frequencies $\delta_1$ is less than $\delta_2$.

The present invention attempts to mitigate this problem.

DISCLOSURE OF THE INVENTION

According to the present invention there is provided a method of encoding an audio signal, the method comprising the steps of claim 1.

A first embodiment of the invention provides a method of using the time warper in the tracking algorithm of a sinusoidal coder. By applying a warp factor, more accurate tracks are obtained. As a result, the sinusoids can be encoded more efficiently. Furthermore, a better audio quality can be obtained by improved phase continuation.

In the first embodiment, the method disclosed in Sluijter et al for determining a warp factor is employed. Preferably, the warp factor of Equation 1 is employed in the tracking algorithm. Since the warp factor indicates the frequency variation that progresses linearly with time, it can be used to indicate the direction of the frequencies. Therefore, this factor can improve the tracking algorithm.

In a second embodiment of the invention, linking sinusoidal components is based on generating a polynomial to fit a number of the last frequency parameters of a track and extrapolating the polynomial to generate an estimate of the next value of frequency parameter of the track. A sinusoidal component of a subsequent segment in the track is linked or not according to the difference in frequencies between the estimate and the frequency parameter of the sinusoidal component.

An advantage the second polynomial fitting embodiment can have over the first warp factor based embodiment is that it does not make any assumption about the signal model, i.e. it does not presume that all tracks or at least contiguous groups of tracks are varying in the same manner. So, if an audio signal contains two main audio components, one decreasing in frequency and the other one increasing in frequency, both can be tracked successfully, whereas this would be less likely to be the case with the first embodiment.

By making more accurate tracks, coding efficiency is increased and better phase continuation is achieved.

DESCRIPTION OF THE PREFERRED EMBODIMENT

Figure 1:
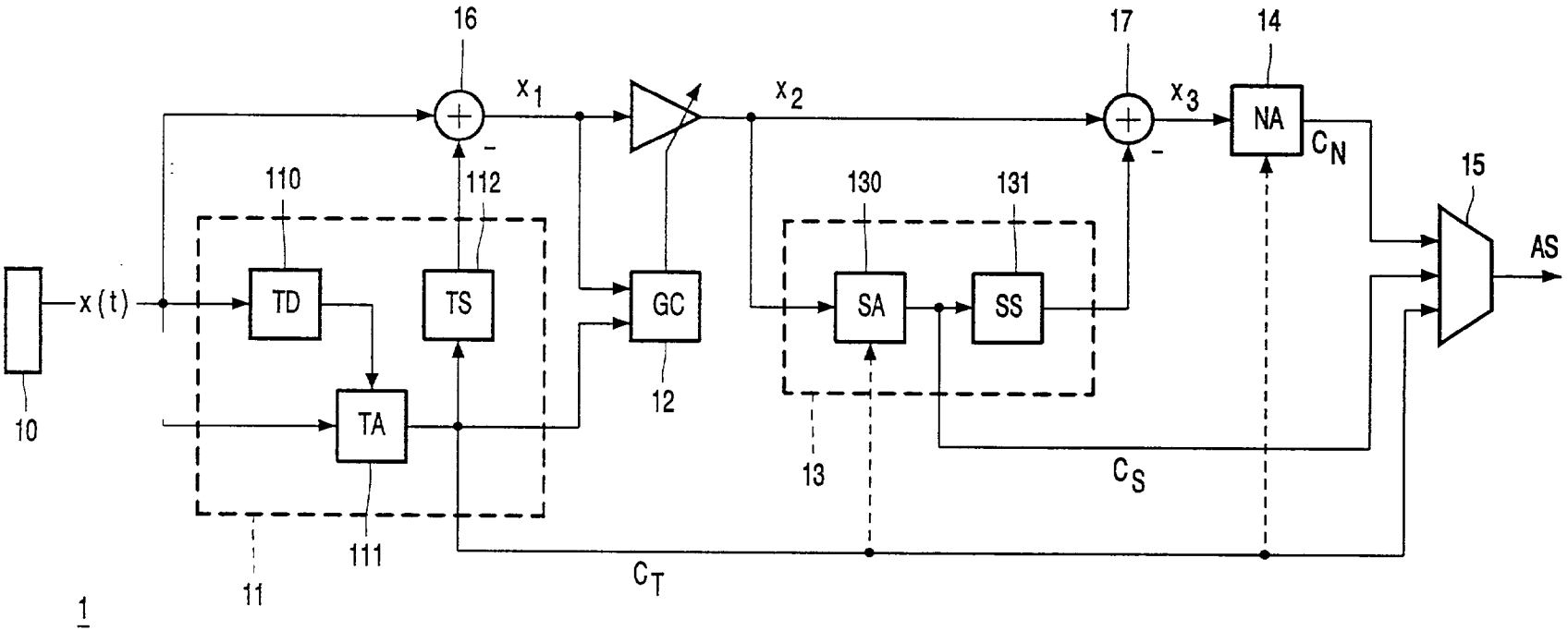
FIG. 1 shows an embodiment of an audio coder according to the invention.

In preferred embodiments of the present invention, FIG. 1, the encoder is a sinusoidal coder of the type described in PCT patent application WO 01/69593-A1 (Attorney Ref. PHNL000120). The operation of this coder and its corresponding decoder has been well described and description is only provided here where relevant to the present invention.

In both the earlier case and the preferred embodiments, the audio coder 1 samples an input audio signal at a certain sampling frequency resulting in a digital representation x(t) of the audio signal. The coder 1 then separates the sampled input signal into three components: transient signal components, sustained deterministic components, and sustained stochastic components. The audio coder 1 comprises a transient coder 11, a sinusoidal coder 13 and a noise coder 14. The audio coder optionally comprises a gain compression mechanism (GC) 12.

The transient coder 11 comprises a transient detector (TD) 110, a transient analyzer (TA) 111 and a transient synthesizer (TS) 112. First, the signal x(t) enters the transient detector 110. This detector 110 estimates if there is a transient signal component and its position. This information is fed to the transient analyzer 111. If the position of a transient signal component is determined, the transient analyzer 111 tries to extract (the main part of) the transient signal component. It matches a shape function to a signal segment preferably starting at an estimated start position, and determines content underneath the shape function, by employing for example a (small) number of sinusoidal components. This information is contained in the transient code CT and more detailed information on generating the transient code CT is provided in WO 01/69593-A1.

The transient code CT is furnished to the transient synthesizer 112. The synthesized transient signal component is subtracted from the input signal x(t) in subtractor 16, resulting in a signal x1. In case, the GC 12 is omitted, x1=x2.

The signal x2 is furnished to the sinusoidal coder 13 where it is analyzed in a sinusoidal analyzer (SA) 130, which determines the (deterministic) sinusoidal components. It will therefore be seen that while the presence of the transient analyser is desirable, it is not necessary and the invention can be implemented without such an analyser. In any case, the end result of sinusoidal coding is a sinusoidal code CS and a more detailed example illustrating the conventional generation of an exemplary sinusoidal code CS is provided in PCT patent application No. WO 00/79519-A1 (Attorney Ref: N 017502).

In brief, however, such a sinusoidal coder encodes the input signal x2 as tracks of sinusoidal components linked from one frame segment to the next. The tracks are initially represented by a start frequency, a start amplitude and a start phase for a sinusoid beginning in a given segment—a birth. Thereafter, the track is represented in subsequent segments by frequency differences, amplitude differences and, possibly, phase differences (continuations) until the segment in which the track ends (death). In practice, it may be determined that there is little gain in coding phase differences. Thus, phase information need not be encoded for continuations at all and phase information may be regenerated using continuous phase reconstruction.

In both the first and second embodiments of the invention, the extent of warping of tracks from one segment to the next is taken into account when linking sinsusoids from one segment to the next. In the first embodiment of the invention, to include a time warp factor in the generation of tracks, the frequencies that are used by the tracking algorithm portion of the sinusoidal coder have to be modified. If no warping is applied, the following equation is evaluated for each frequency in frame k and frame k+1:

$$Df=|e(f_{k+1})-e(f_k)|, \qquad \text{Equation 2}$$

where e(.) denotes an arbitary mapping function, e.g. e(.) is the frequency in ERB, and f denotes a frequency in a frame. So in the example of FIG. 6(*a*), $\delta_1$ and $\delta_2$ are included in the tracking algorithm cost function to determine which of frequencies $f_{k+1}(1)$ or $f_{k+1}(2)$ are linked to $f_k$, with one of frequency differences $\delta_1$ or $\delta_2$ being transmitted according to which frequency is linked. (It is also known to include information about amplitudes and phases in the cost function—but this is not relevant for the purposes of the first embodiment.)

In the first embodiment, the warp factor is used in the sinusoidal coder tracking algorithm as follows. The frequencies of frame k and frame k+1 are transformed to frequencies $\tilde{f}_k$ and $\tilde{f}_{k+1}$ as follows:

$$\tilde{f}_{k,1} = f_k\left(1 + \frac{a_k}{T}\frac{L}{2}\right), \qquad \text{Equation 3}$$

$$\tilde{f}_{k+1,2} = f_{k+1}\left(1 - \frac{a_{k+1}}{T}\frac{L}{2}\right),$$

where $a_1$ is the warp factor of frame i, T is the segment size on which a is determined (e.g 32.7 ms), and L is the update interval of the frequencies (e.g. 8 ms). As will be seen from the second embodiment below, the invention is not limited to the above formula or particular method for determining a warp factor as disclosed by Sluijter et al. Neither is an even division of the update interval required, so that, rather than L/2, an L1 may be used to determine $\tilde{f}_{k,1}$ and an L2 used to determine $\tilde{f}_{k+1,2}$ where L1+L2=L.

The frequencies $\tilde{f}_{k,1}$ and $\tilde{f}_{k+1,2}$ thus take into account the time warp factor. Now the tracking algorithm, when determining frequency differences from one segment to the next, uses a modified Equation 2 as follows:

$$Df = |e(\tilde{f}_{k+1,2}) - e(\tilde{f}_{k,1})|, \qquad \text{Equation 4}$$

Figure 6A:
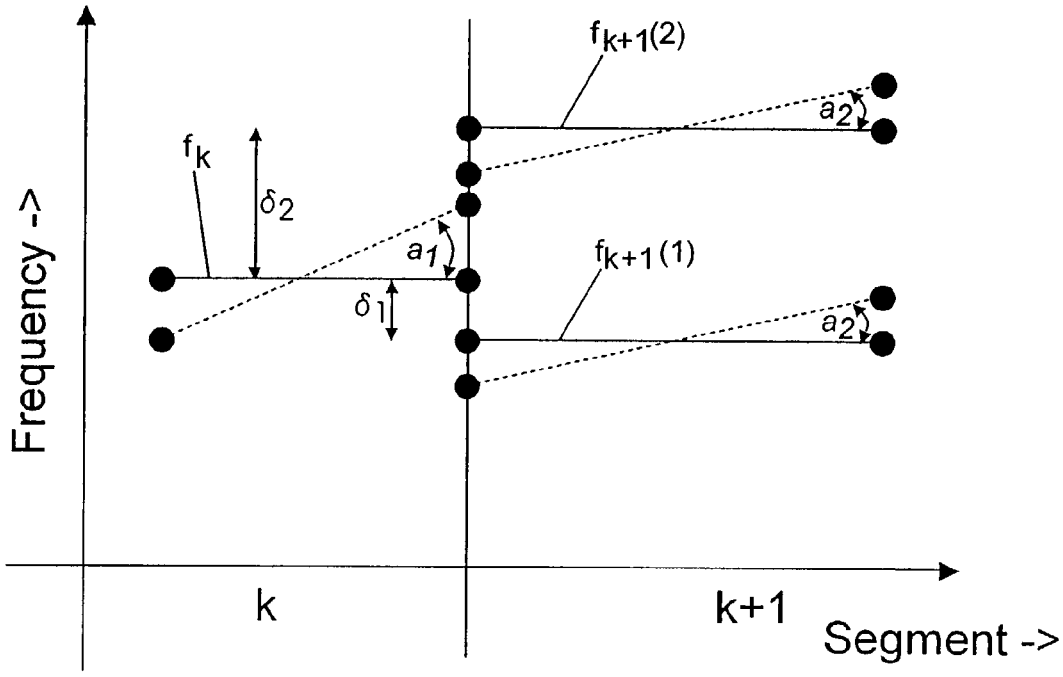
FIG. 6(*a*) and FIG. 6(*b*) show frequencies and warping determined by a prior art audio coder and an audio coder according to a first embodiment of the invention respectively.
Figure 6B:
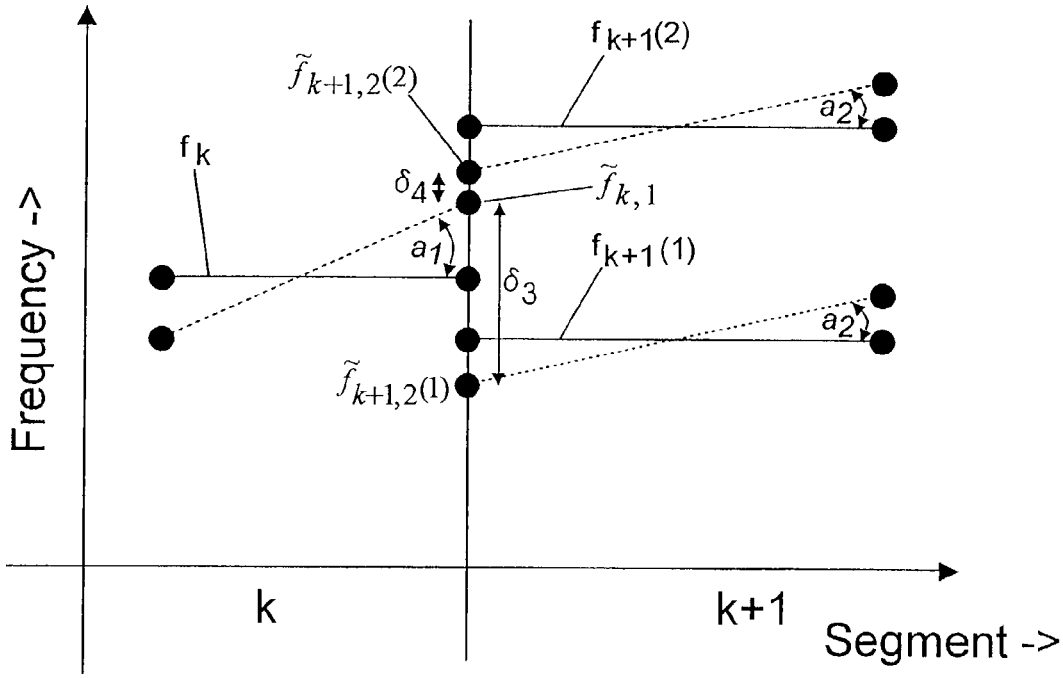

This will, for example, produce frequency differences $\delta_3$ and $\delta_4$, FIG. 6(*b*), when the cost function is applied to the interval k, k+1, so making the tracking algorithm much more likely to link $f_k$ with $f_{k+1}(2)$ rather than $f_{k+1}(^1)$. The other parts of the tracking algorithm can remain unmodified.

Figure 4:
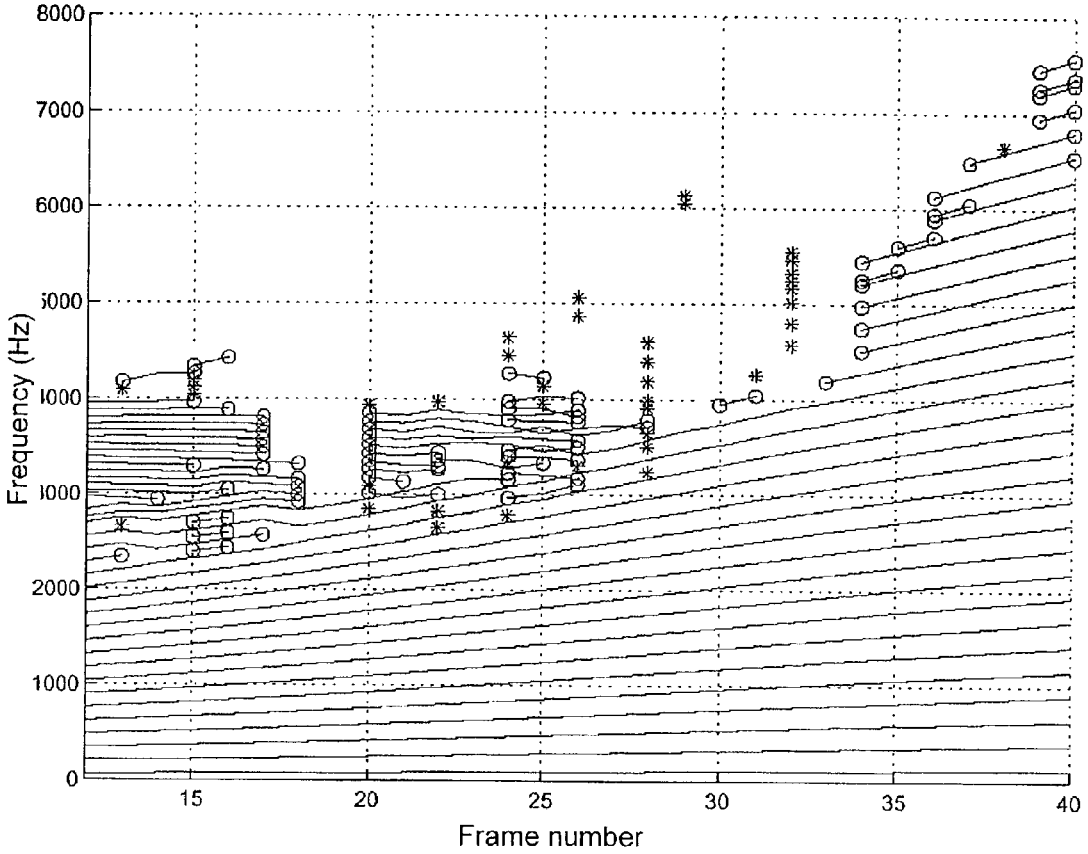
FIG. 4 shows tracks determined by an audio coder when no warping is applied at all.
Figure 5:
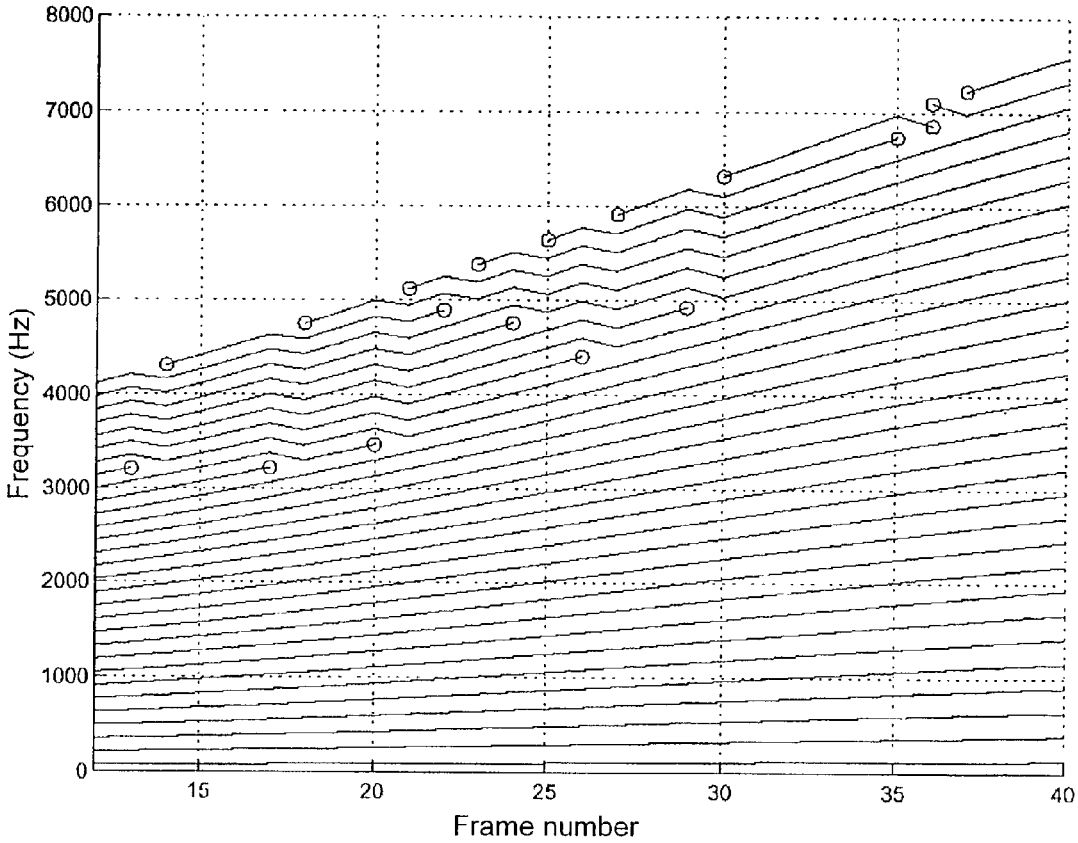
FIG. 5 shows tracks determined by an audio coder when warping is used in frequency estimation but not in tracking.
Figure 7:
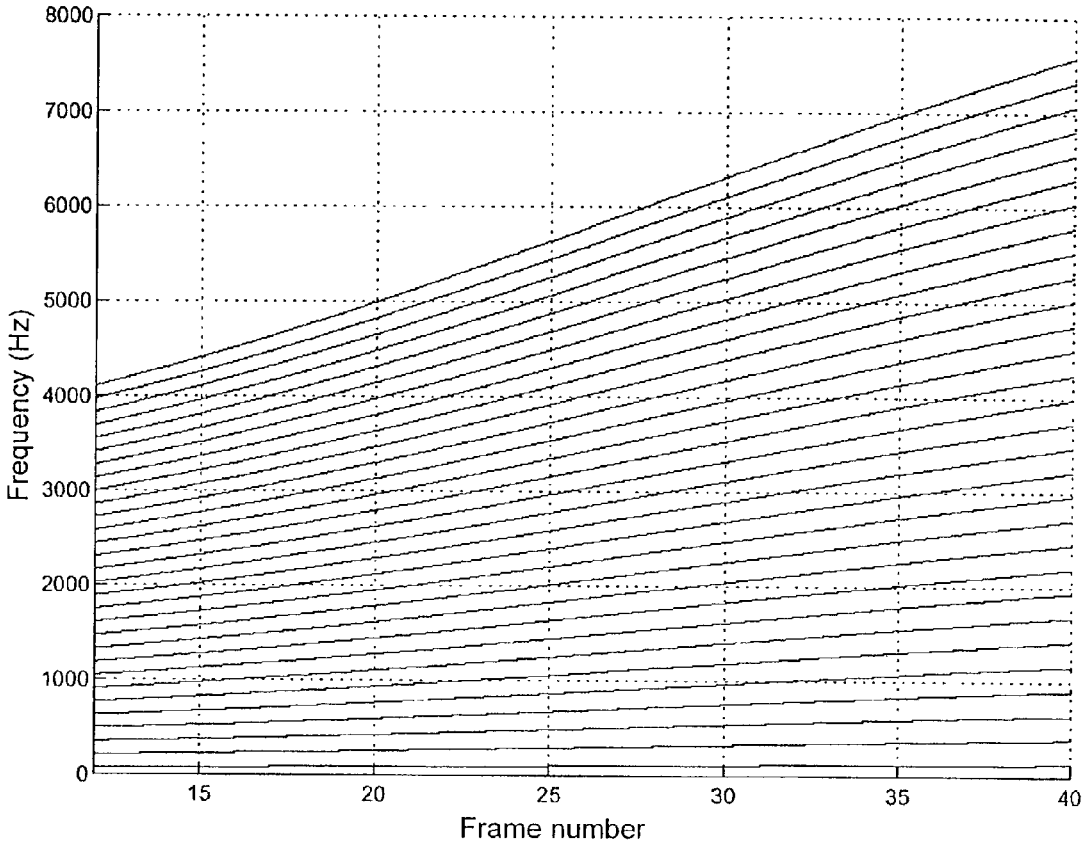
FIG. 7 shows tracks determined by an audio coder according to a first embodiment of the invention when a warp factor is used both in frequency estimation and in tracking.

By applying the tracking algorithm, that includes the time warp factor, on the examples of FIGS. 4 and 5, the tracks as shown in FIG. 7 are obtained, and it will be seen that in this case, no incorrect links are made.

In the first embodiment, the warp factor is further used to save bit rate for transmitting modified frequency differences from segment to segment. Equation 2 shows that by transmitting difference Df (and a sign bit), frequency $f_{k+1}$ can be obtained from frequency $f_k$. In the first embodiment, however, frequency differences according to equation 4 together with a warp factor and sign bits are transmitted.

Figure 8:
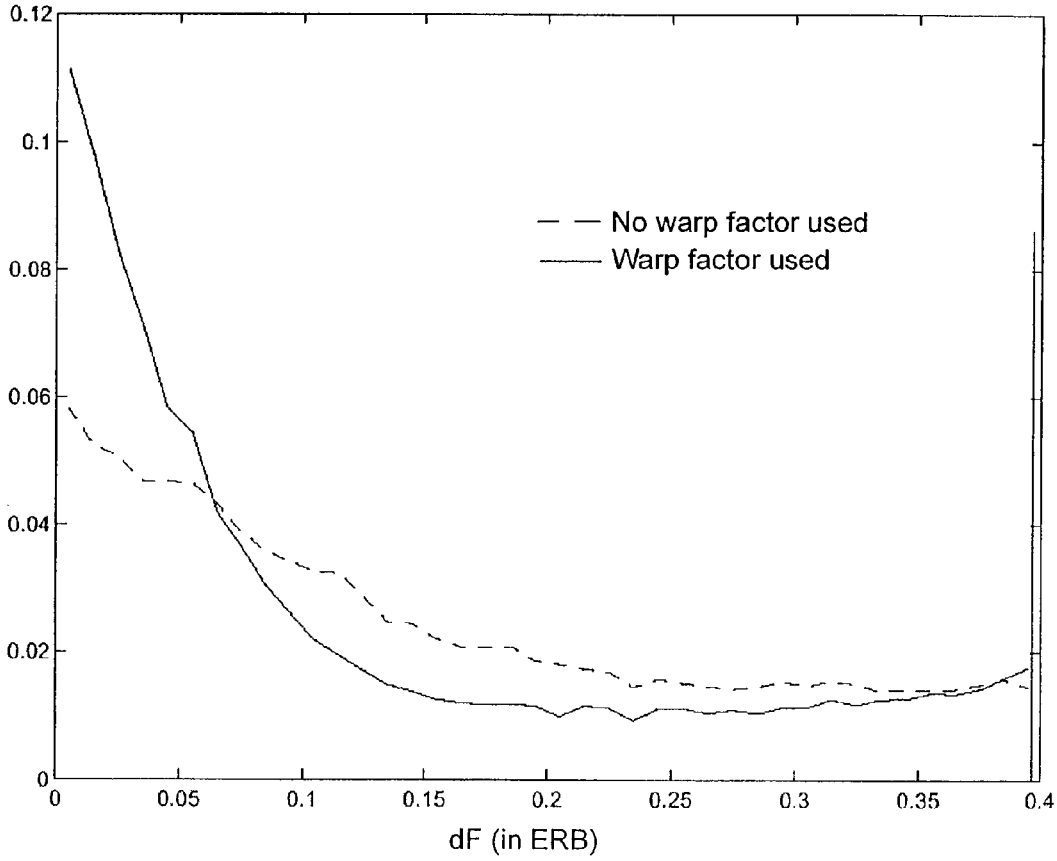
FIG. 8 shows the distribution of frequency differences (dF) obtained from a real speech signal of 8.6 seconds for both a prior art audio coder and an audio coder according to the first embodiment of the invention.

FIG. 8 shows the distribution of Df, obtained from a real speech signal with duration of 8.6 seconds. The dash-dotted line is the distribution of Df of Equation 2, whereas the solid line represents the distribution of Df of Equation 4, which includes a warp factor. As can be seen from the figure, the distribution is more peaked when a warp factor is used. This is because (as illustrated in FIG. 6(*b*) vis-á-vis FIG. 6(*a*)) using the frequency differences of equation 4 in general produces smaller frequency differences within linked tracks.

By using entropy coding to encode frequency differences within this more defined frequency difference profile, the resulting signal will therefore either require less bits or be of higher quality. This is because for a given coding quantization scheme, there should be more symbols occurring in the most frequently used and so most compressed symbols, or alternatively a more focused quantization scheme should produce better discrimination for the same bit rate.

Figure 9A:
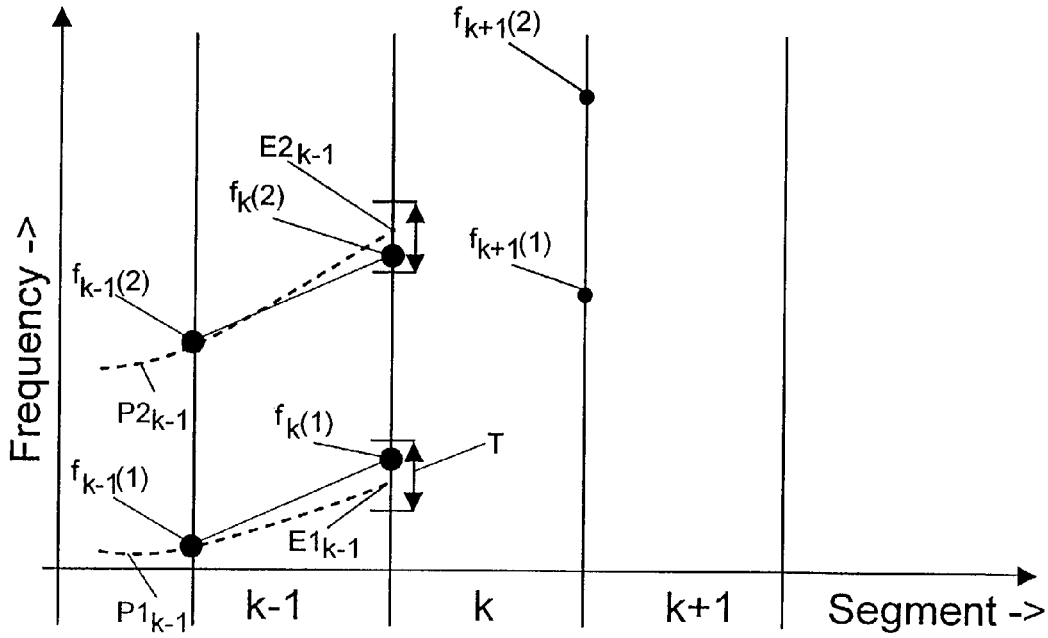
FIG. 9(*a*) to 9(*c*) show tracks formed according to a second embodiment of the invention.
Figure 9B:
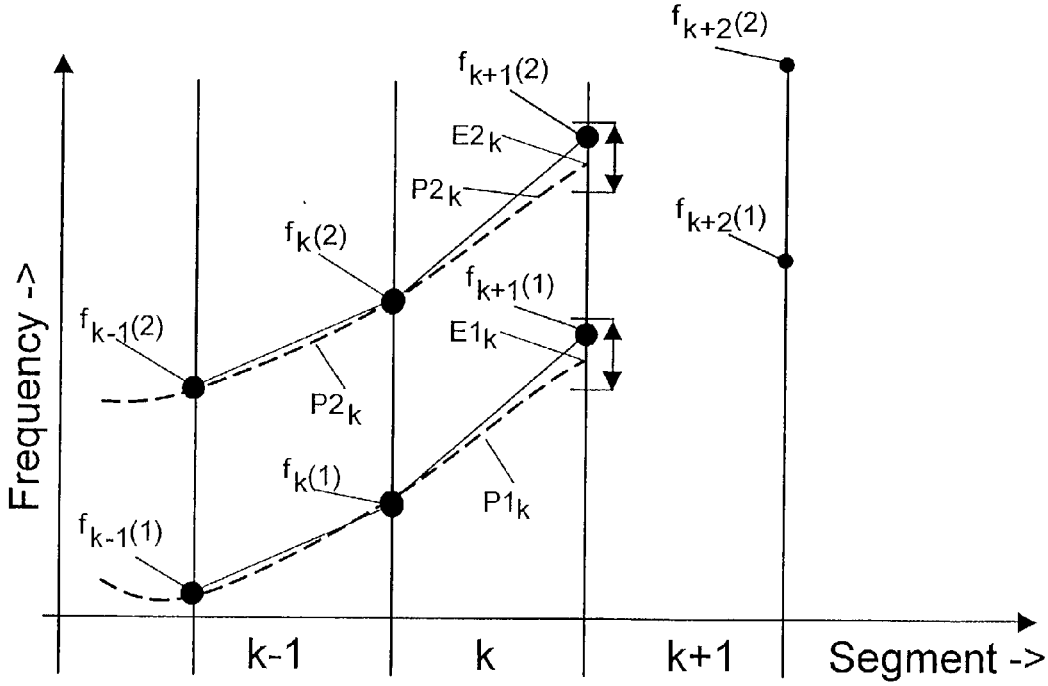
Figure 9C:
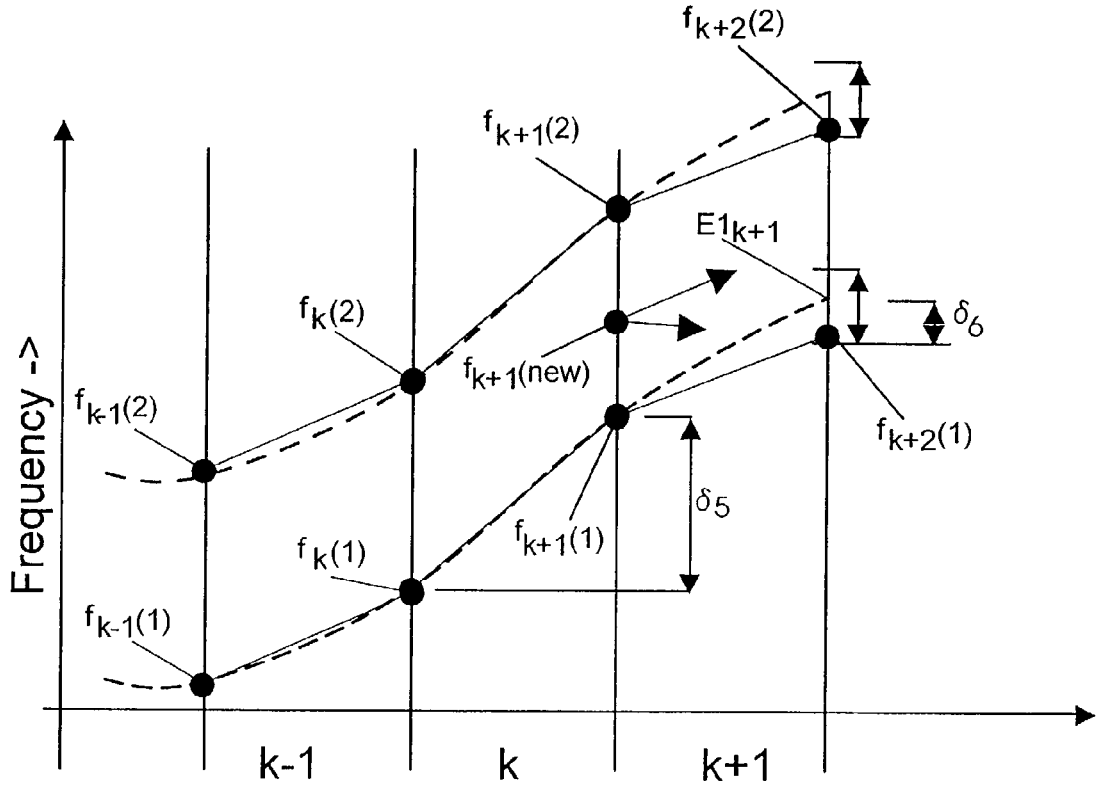

In a second embodiment of the invention, the extent of warping of tracks from one segment to the next is taken into account on a track by track basis. Referring now to FIGS. 9(*a*) to 9(*c*), where the frequency parameters $f_{k-1}(1)$, $f_{k-1}$, (2), $f_k(1)$, $f_k(2)$ etc. of sinusoidal components across a number of time segments of a signal is shown. Consider two segments of time k−1 and k, the formation of tracks is usually based on the similarity between the parameters of the two sets of sinusoidal components found at the interface (or overlap) of these segments.

On the other hand, the second embodiment uses the evolution, potentially extending along a number of segments, of the frequency, and preferably the amplitude and the phase of the sinusoidal components of the tracks, until and including time segment k−1, to make a prediction of the frequency, and preferably the amplitude and the phase parameters of the sinusoidal components that could exist for time segment k, if the tracks were continuing.

The prediction of the frequency, amplitude and phase of the possible continuations are obtained by fitting a polynomial preferably of the form $a+bx+cx^2+dx^3$ . . . to the set of parameters along the track until the time segment k−1. In the case of track 1 which comprises a component with frequency $f_{k-1}(1)$ in segment k−1, the polynomial passing through this point is referred to a $P\mathbf{1}_{k-1}$ and similarly for track two. Corresponding polynomials (not shown) may be fitted to the amplitude and phase parameters of the components. Estimations of the frequency and where applicable the amplitude and the phase parameters of the possible following component are obtained by computation of the value of those polynomials at the time segment k. In the case of track 1, the frequency estimate is referred to as $E\mathbf{1}_{k-1}$ and similarly for track 2.

The formation of tracks is then based on the similarity between this set of predicted/estimated parameters and the parameters of the components really extracted at time segment k—in this case the frequency parameters are $f_k(1)$ and $f_k(2)$. If these frequency parameters fall within a tolerance T from the frequency estimates, the associated component becomes a candidate for being linked to the track for which the estimate is made.

So in the example of FIG. 9(*a*), presuming that the amplitude and/or phase estimates for tracks 1 and 2 also match the amplitude and phase parameters for the components $f_k(1)$ and $f_k(2)$, these components will be linked to tracks 1 and 2 respectively.

Now advancing to FIG. 9(*b*), where the polynomials $P\mathbf{1}_K$ and $P\mathbf{2}_K$ are fitted to the frequency parameters for segments up to and including k−1 and k to provide a set of estimates $E\mathbf{1}_k$ and $E\mathbf{2}_k$. In this case, the tracking algorithm now either: extends the order of the polynomials $P\mathbf{1}_{K-1}$ and $P\mathbf{2}_{K-1}$ for tracks 1 and 2 used to make the estimates $E\mathbf{1}_{k-}1$ and $E\mathbf{2}_{k-1}$ for the previous segment; or, if a maximum order of polynomial for a track was reached for the previous estimates, the segments on which the estimates are based are advanced by one for that track.

In the preferred version of the second embodiment, a maximum order of 4 is used for the polynomials fitted to frequency parameters, 3 is used for the polynomials fitted to amplitude parameters, and 2 is used for the polynomials fitted to phase parameters.

Turning now to FIG. 9(*c*), where a new component having a frequency parameter $f_{k+1}$(new) exists for the segment k+1. In the first warp factor embodiment, it is presumed that all tracks or at least contiguous groups of tracks are evolving in the same manner within a segment. Thus where, for example, a track starts within a segment, it is assumed that it will have warped to the same extent as tracks in its vicinity. In the example of FIG. 9(*c*), the new component might therefore not find a link in the subsequent segment k+2 and because the new track including only this single component would then be considered too short a track, it would simply be ignored in generating the final bitstream.

In the second embodiment, however, different tracks may be allowed to vary freely with respect to other tracks according only to the prior history of a given track—in so far as it is available. This can be considered to lead to potential problems, where a new track may start with a frequency parameter in the vicinity of adjacent varying tracks. Thus, in the example, $f_{k+1}$(new) might be linked to $f_{k+2}(1)$ instead of the more likely candidate $f_{k+1}(1)$ being linked to $f_{k+2}(1)$.

However, in the case of the new component $f_{k+1}$(new), in the second embodiment, the tracking algorithm can also take into account amplitude and/or phase predictions. These may help to ensure that the correct links are made, because, for example, $f_{k+2}(1)$ might be more likely to be in-phase with $f_{k+1}(1)$ than $f_{k+1}$(new).

It will be seen that the coding gain of transmitting only the frequency differences such as $\delta_4$, of the first embodiment may be lost if frequency differences such as $\delta_5$ between subsequent frequency components of a track generated according to the second embodiment are encoded in the bitstream.

This has an advantage in that a decoder need then not be aware of the form of polynomial prediction employed within the encoder and as such it will be seen that the invention is not limited to any particular form of polynomial.

However, there can also be similar coding gains in the second polynomial based embodiment. Here, the encoder transmits the frequency difference, for example $\delta_6$, and preferably amplitude difference and/or phase difference that was determined between the estimate, in this case $E1_{k+1}$, and the linked component parameter, in this case $f_{k+2}(1)$ from segment k+2. The decoder then needs to make a prediction via a polynomial fitting of the tracks already received up to a time segment say k+1 (same operation than in the encoder) before employing the frequency and amplitude and/or phase difference parameters for segment k+2. No extra factor such as the warp factor needs to be sent in this case, however, the decoder does need to be aware of the form of polynomial used in the encoder.

It will therefore been seen that the polynomials of the second embodiment encapsulate with a greater degree of freedom the warping of component parameters from segment to segment than using the alternative warp factor of the first embodiment.

However, regardless of which embodiment is used, as in the prior art, from the sinusoidal code CS generated with the improved sinusoidal coder of the invention, the sinusoidal signal component is reconstructed by a sinusoidal synthesizer (SS) 131. This signal is subtracted in subtractor 17 from the input x2 to the sinusoidal coder 13, resulting in a remaining signal x3 devoid of (large) transient signal components and (main) deterministic sinusoidal components.

The remaining signal x3 is assumed to mainly comprise noise and the noise analyzer 14 of the preferred embodiment produces a noise code CN representative of this noise, as described in, for example, PCT patent application No. WO 01/89086-A1 (Attorney Ref: PH NL000287). Again, it will be seen that the use of such an analyser is not essential to the implementation of the present invention, but is nonetheless complementary to such use.

Finally, in a multiplexer 15, an audio stream AS is constituted which includes the codes CT, CS and CN. The audio stream AS is furnished to e.g. a data bus, an antenna system, a storage medium etc.

Figure 2:
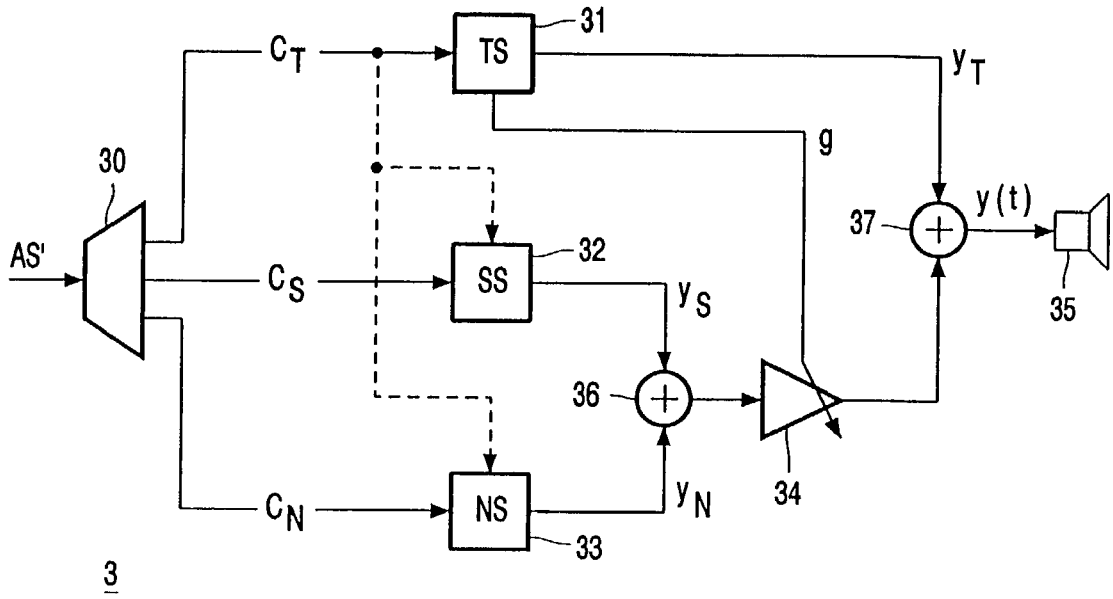
FIG. 2 shows an embodiment of an audio player according to the invention.

FIG. 2 shows an audio player 3 according to the invention. An audio stream AS', e.g. generated by an encoder according to FIG. 1, is obtained from the data bus, antenna system, storage medium etc. The audio stream AS is de-multiplexed in a de-multiplexer 30 to obtain the codes CT, CS and CN. These codes are furnished to a transient synthesizer 31, a sinusoidal synthesizer 32 and a noise synthesizer 33 respectively. From the transient code CT, the transient signal components are calculated in the transient synthesizer 31. In case the transient code indicates a shape function, the shape is calculated based on the received parameters. Further, the shape content is calculated based on the frequencies and amplitudes of the sinusoidal components. If the transient code CT indicates a step, then no transient is calculated. The total transient signal yT is a sum of all transients.

The sinusoidal code CS is used to generate signal yS, described as a sum of sinusoids on a given segment. Where an encoder according to the first embodiment has been employed, in order to decode the frequencies, the warping parameter for each segment has to be known at the decoder side. In the decoder, the phase of a sinusoid in a sinusoidal track is calculated from the phase of the originating sinusoid and the frequencies of the intermediate sinusoids. When no warp factor is used in the decoder, phase $\phi_k$ of frame k is calculated as:

$$\phi_k = \phi_{k-1} + \frac{2\pi L}{2}(f_k + f_{k-1}), \qquad \text{Equation 5}$$

where L is the update interval (in seconds) of the frequencies and $f_k$ and $f_{k-1}$ are frequencies (in Hertz) of frame k and frame k−1, respectively. By including the warp factor, the phase can be computed by:

$$\phi_k = \phi_{k-1} + 2\pi\left[\frac{L}{2}(f_k + f_{k-1}) + \left(\frac{L}{2}\right)^2\left(\frac{a_{k-1}}{T}f_{k-1} - \frac{a_k}{T}f_k\right)\right]. \qquad \text{Equation 6}$$

It will be seen, however that other functions can also supply approximations for the phase and the invention is not limited to Equation 6. In any case, the use of such a function means that the continuous phase will better match the original phase by including the warp factor.

Where an encoder according to the second embodiment of the invention was employed to generate the bitstream, then if frequency differences such as $\delta_5$ are encoded in the bitstream, a prior art type decoder can be used to synthesize the signal as it need not be aware that improved linking has been used to generate the tracks of the sinusoidal codes.

If the encoder such as disclosed by Sluijter et al has employed warping to better estimate sinusoidal parameters and included the warp factor in the bitstream, then this warp factor can be used in synthesizing the sinusoidal components of the bistream to better replicate the original signal.

However, as mentioned previously, if the encoder according to the second embodiment includes frequency differences such as $\delta_6$ in the bitstream, then the decoder will need to generate the polynomials used in the tracking algorithm to determine the subsequent frequency and amplitude and/or phase parameters for subsequent sinusoidal components of tracks.

At the same time, the noise code CN is fed to a noise synthesizer NS 33, which is mainly a filter, having a frequency response approximating the spectrum of the noise. The NS 33 generates reconstructed noise yN by filtering a white noise signal with the noise code CN.

The total signal y(t) comprises the sum of the transient signal yT and the product of any amplitude decompression (g) and the sum of the sinusoidal signal yS and the noise signal yN. The audio player comprises two adders 36 and 37 to sum respective signals. The total signal is furnished to an output unit 35, which is e.g. a speaker.

Figure 3:
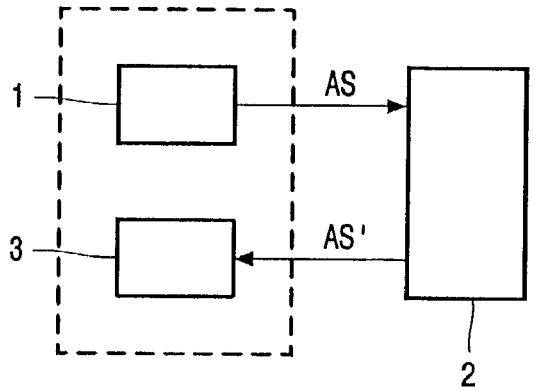
FIG. 3 shows a system comprising an audio coder and an audio player according to the invention.

FIG. 3 shows an audio system according to the invention comprising an audio coder 1 as shown in FIG. 1 and an audio player 3 as shown in FIG. 2. Such a system offers playing and recording features. The audio stream AS is furnished from the audio coder to the audio player over a communication channel 2, which may be a wireless connection, a data 20 bus or a storage medium. In case the communication channel 2 is a storage medium, the storage medium may be fixed in the system or may also be a removable disc, memory stick etc. The communication channel 2 may be part of the audio system, but will however often be outside the audio system.

In the first embodiment, the use of only one warp factor per segment is described. However, it will be seen that several warp factors per frame may be used. For example, for every frequency or group of frequencies a separate warp factor may be determined. Then, the appropriate warp factor can be used for each frequency in the equations above.

The present invention can be used in any sinusoidal audio coder. As such, the invention is applicable anywhere such coders are employed.

The invention also applies to objects which are combinations of frequency tracks. For example, some sinusoidal coders can be arranged to identify within a set of sinusoidal components one or more fundamental frequencies, each with a set of harmonics. An encoding advantage can be gained by transmitting such components as harmonic complexes each comprising parameters relating to the fundamental frequency and, for example, the spectral shape relating to its associated harmonics. It will therefore be seen that when linking such complexes from segment to segment, either the warp factor(s) determined for each segment or polynomial fitting can be applied to the components of such complexes to determine how these should be linked in accordance with the invention.

The invention claimed is:

1. A method of encoding an audio signal (x), the method comprising providing a respective set of sampled signal values for each of a plurality of sequential segments;

analysing the sampled signal values to generate one or more sinusoidal components ($f_k$,$f_{k+1}$) for each of the plurality of sequential segments;

providing an indicator ($a_i$, P1$_k$) of the frequency variation of said sinusoidal components within each of the plurality of sequential segments;

linking sinusoidal components across a plurality of sequential segments according to the difference in the slope of frequencies ($\delta_4$,$\delta_6$) of sinusoidal components to which respective indicators ($a_1$,P1$_k$) are applied;

generating sinusoidal codes (CS) comprising tracks of linked sinusoidal components for each of the plurality of sequential segments; and generating an encoded audio stream (AS) including said sinusoidal codes (CS).

2. A method according to claim 1 wherein said indicator comprises at least one warp factor ($a_i$) associated with each segment of said audio signal and wherein said linking step comprises applying warp factors to the frequency parameters of sinusoidal components of associated subsequent segments to determine said difference in the slope of the frequencies.

3. A method according to claim 1 in which said analysing step comprises employing a warp factor to generate said one or more sinusoidal components ($f_k$,$f_{k+1}$).

4. A method according to claim 1 in which each track comprises a frequency, amplitude and phase for a sinusoidal component in a starting segment of a track and a frequency and amplitude difference for each sinusoidal component 5 in a subsequent continuation segment of said track.

5. A method according to claim 4 wherein said frequency slope difference comprises a difference in the slope of the frequencies ($\delta_4$,$\delta_6$) at a segment boundary of linked sinusoidal components to which respective indicators are applied.

6. A method according to claim 2 wherein said sinusoidal codes include said warp factors ($a_i$).

7. A method as claimed in claim 1 wherein said method further comprises:

estimating a position of a transient signal component in the audio signal;

matching a shape function having shape parameters and a position parameter to said transient signal; and including the position and shape parameters describing the shape function in said audio stream (AS).

8. A method as claimed in claim 1, the method further comprising:

modeling a noise component of the audio signal by determining filter parameters of a filter which has a frequency response approximating a target spectrum of the noise component, and including said filter parameters in said audio stream (AS).

9. A method as claimed in claim 1 wherein said providing step comprises: sampling the audio signal (x) at a first sampling frequency to generate said sampled signal values.

10. A method as claimed in claim 1 wherein said linking step links sinusoidal components according to the difference in the slope of the frequencies ($\delta_4$, $\delta_6$) of sinusoidal components at segment boundaries.

11. A method of encoding an audio signal, the method comprising:

providing a respective set of sampled signal values for each of a plurality of sequential segments;

analysing the sampled signal values to generate one or more sinusoidal components ($f_k$,$f_{k+1}$) for each of the plurality of sequential segments;

providing an indicator ($a_i$, P1$_k$) of the frequency variation of said sinusoidal components within each of the plurality of sequential segments, said indicator being a polynomial (P1$_k$);

linking sinusoidal components across a plurality of sequential segments according to the difference in frequencies ($\delta_4$, $\delta_6$) of sinusoidal components to which respective indicators ($a_1$,P1$_k$) are applied;

generating sinusoidal codes (CS) comprising tracks of linked sinusoidal components for each of the plurality of sequential segments; and generating an encoded audio stream (AS) including said sinusoidal codes (CS), and wherein said linking step comprises for each track of a segment, generating said polynomial (P1$_k$) to fit a number of the last frequency parameters of a track and extrapolating said polynomial to generate an estimate of the next value of frequency parameter of said track, and linking a sinusoidal component of a subsequent segment in the track according to the difference in frequencies between said estimate and the frequency parameter of said sinusoidal component.

12. A method according to claim 11 wherein the maximum number of last frequency parameters is five.

13. A method according to claim 11 wherein said linking step further comprises the step of:

for each track of a segment, generating a second polynomial to fit a number of the last amplitude parameters of a track and extrapolating said second polynomial to generate an estimate of the next value of amplitude parameter of said track, and linking a sinusoidal component of a subsequent segment in the track according to the difference in frequencies and amplitudes between said frequency and amplitude estimates and the frequency and amplitude parameters of said sinusoidal component.

14. A method according to claim 13 wherein the maximum number of last amplitude parameters is four.

15. A method according to claim 11 wherein said linking step further comprises the step of:

for each track of a segment, generating a second polynomial to fit a number of the last phase parameters of a track and extrapolating said second polynomial to generate an estimate of the next value of phase parameter of said track, and linking a sinusoidal component of a subsequent segment in the track according to the difference in frequencies and phases between said frequency and phase estimates and the frequency and phase parameters of said sinusoidal component.

16. A method according to claim 15 wherein the maximum number of last phase parameters is three.

17. Method of decoding an audio stream, the method comprising:

reading an encoded audio stream (AS') including sinusoidal codes (CS) comprising tracks of linked sinusoidal components for each of a plurality of sequential segments of the audio stream; and employing an indicator ($a_i$,P1$_k$) of the frequency variation of said sinusoidal components within each of the plurality of sequential segments and said sinusoidal codes to synthesize said audio signal including re-constructing sinusoidal components across a plurality of sequential segments according to the difference in the slope of frequencies ($\delta_4$, $\delta_6$) of sinusoidal components to which respective indicators have been applied.

18. A method according to claim 17 in which a frequency ($f_{k+,2}$, $f_{k+1}$), e.g. a start frequency, of a sinusoidal component in a segment is determined from a frequency slope difference ($\delta_4$, $\delta_6$) and the frequency ($f_{k,1}$, $f_k$) of a linked sinusoidal component to which said indicator has been applied.

19. A method according to claim 17 in which said indicator comprises at least one warp factor ($a_i$) for each segment.

20. A method according to claim 19 in which a phase of a sinusoidal component in a segment is determined from a phase of a linked sinusoidal component to which a warp factor has been applied.

21. A method according to claim 20 in which the phase ($\Phi_k$) of said sinusoidal components in a segment k is re-constructed according to the equation:

$$\phi_k = \phi_{k-1} + 2\pi\left[\frac{L}{2}(f_k + f_{k-1}) + \left(\frac{L}{2}\right)^2\left(\frac{a_{k-1}}{T}f_{k-1} - \frac{a_k}{T}f_k\right)\right]$$

where L is the segment size (in seconds), $f_i$ is the frequency (in Hertz) of the sinusoidal component in segment I and T represents the duration of the segment in seconds.

22. Method of decoding an audio stream, the method comprising:

reading an encoded audio stream (AS') including sinusoidal codes (CS) comprising tracks of linked sinusoidal components for each of the plurality of sequential segments; and employing an indicator ($a_i$,P1$_k$) of the frequency variation of said sinusoidal components within each of the plurality of sequential segments and said sinusoidal codes to synthesize said audio signal including re-constructing sinusoidal components across a plurality of sequential segments according to the difference in frequencies ($\delta_4$, $\delta_6$) of sinusoidal components to which respective indicators have been applied, said indicator being a polynomial (P1$_k$) and wherein said employing step comprises:

synthesizing each track of a segment by generating said polynomial (P1$_k$) to fit a number of the last frequency parameters of a track and extrapolating said polynomial to generate an estimate of the next value of frequency parameter of said track, and determining a sinusoidal component of a subsequent segment in the track according to the difference in frequencies between said estimate and the frequency parameter of said sinusoidal component.

23. Audio coder arranged to process a respective set of sampled signal values for each of a plurality of sequential segments of an audio signal (x), said coder comprising:

an analyser for analysing the sampled signal values to generate one or more sinusoidal components ($f_k$,$f_{k+1}$) for each of the plurality of sequential segments;

a component for determining an indicator ($a_i$,P1$_k$) of the frequency variation of said sinusoidal components within each of the plurality of sequential segments;

a linker for linking sinusoidal components across a plurality of sequential segments according to the difference in the slope of frequencies ($\delta_4$,$\delta_6$)of sinusoidal components to which respective indicators ($a_i$ ,P1$_k$) are applied;

a component for generating sinusoidal codes (CS) comprising tracks of linked sinusoidal components for each of the plurality of sequential segments; and a bit stream generator for generating an encoded audio stream (AS) including said sinusoidal codes (CS).

24. Audio player comprising:

means for reading an encoded audio stream (AS') including sinusoidal codes (CS) comprising tracks of linked sinusoidal components for each of a plurality of sequential segments of the audio stream; and a synthesizer arranged to employ an indicator ($a_i$,P1$_k$) of the frequency variation of said sinusoidal components within each of a plurality of sequential segments and said sinusoidal codes to synthesize said audio signal including re-constructing sinusoidal components across a plurality of sequential segments according to the difference in the slope of frequencies ($\delta_4$,$\delta_6$) of sinusoidal components to which respective indicators have been applied.

25. Audio system comprising an audio coder as claimed in claim 23.

26. Audio stream (AS) comprising sinusoidal codes (CS) representative of at least a component of an audio signal, said codes comprising tracks of linked sinusoidal components, said sinusoidal components being linked across a plurality of sequential segments according to the difference in the slope of frequencies ($\delta_4$, $\delta_6$) of said sinusoidal components to which respective indicators ($a_i$,P1$_k$) of the frequency variation of said sinusoidal components within each of the plurality of sequential segments of said audio signal have been applied.

27. Storage medium on which an audio stream (AS) as claimed in claim 26 has been stored.

28. A method of encoding an audio signal, the method comprising:

providing a respective set of sampled signal values for each of a plurality of sequential segments;

analysing the sampled signal values to generate one or more sinusoidal components ($f_k$,$f_{k+1}$) for each of the plurality of sequential segments;

providing an indicator ($a_i$, P1$_k$) of the frequency variation of said sinusoidal components within each of the plurality of sequential segments;

linking, sinusoidal components across a plurality of sequential segments according to the difference in the slope of trequencies ($\delta_4$,$\delta_6$) of sinusoidal components to which respective indicators ($a_i$,P1$_k$) are applied, said frequency difference comprising a difference in the frequencies ($\delta_4$,$\delta_6$) at a segment boundary of linked sinusoidal components to which respective indicators are applied;

generating sinusoidal codes (CS) comprising tracks of linked sinusoidal components for each of the plurality of sequential segments, each track comprising a frequency, amplitude and phase for a sinusoidal component in a starting segment of a track and a frequency and amplitude difference for each sinusoidal component in a subsequent continuation segment of said track; and generating an encoded audio stream (AS) including said sinusoidal codes (CS).

29. Method of decoding an audio stream, the method comprising:

reading an encoded audio stream (AS') including sinusoidal codes (CS) comprising tracks of linked sinusoidal components for each of a plurality of sequential segments of the audio stream;

employing an indicator ($a_i$,P1$_k$) of the frequency variation of said sinusoidal components within each of the plurality of sequential segments and said sinusoidal codes to synthesize said audio signal including re-constructing sinusoidal components across a plurality of sequential segments according to the difference in frequencies ($\delta_4$, $\delta_6$) of sinusoidal components to which respective indicators have been applied, said indicator comprising at least one warp factor ($a_i$) for each segment; and determining a phase of a sinusoidal component in a segment from a phase of a linked sinusoidal component to which a warp factor has been applied, the phase ($\Phi_k$) of said sinusoidal components in a segment k being re-constructed according to the equation:

$$\Phi_k=\Phi_{k-1}+2\pi[L/2(f_k+f_{k-1})+(L/2)^2(\alpha_{k-1}/T\,f_{k-1}-\alpha_k/T\,f_k)]$$

where L is the segment size (in seconds), $f_i$ is the frequency (in Hertz) of the sinusoidal component in segment I and T represents the duration of the segment in seconds.

* * * * *